US005405276A

United States Patent [19]

Kato

[11] Patent Number: 5,405,276

[45] Date of Patent: Apr. 11, 1995

[54] WATER INJECTION PROPULSION DEVICE

[75] Inventor: Naoki Kato, Hamamatsu, Japan

[73] Assignee: Sanshin Kogyo Kabushiki Kaisha, Hamamatsu, Japan

[21] Appl. No.: 127,628

[22] Filed: Sep. 27, 1993

[30] Foreign Application Priority Data

Sep. 25, 1992 [JP] Japan ..... 4-279197

[51] Int. Cl.[6] ..... B63H 11/00

[52] U.S. Cl. ..... 440/38; 440/75

[58] Field of Search ..... 114/270; 440/38, 75; 123/195 P, 198 R, 195 R, 198 P, 52 MC

[56] References Cited

U.S. PATENT DOCUMENTS 2,769,420 11/1956 Horton et al. ..... 440/75

5,030,149 7/1991 Fujita ..... 440/75

FOREIGN PATENT DOCUMENTS 59098 5/1980 Japan ..... 440/75

61-67695 4/1986 Japan .

*Primary Examiner*—Stephen P. Avila

*Attorney, Agent, or Firm*—Knobbe, Martens, Olson & Bear

[57] ABSTRACT

Several embodiments of jet propulsion drive units for watercraft wherein the engine outer housing is provided with an integral step down transmission so that the engine can be a high speed, low displacement engine and still drive the jet propulsion unit without causing cavitation. In one embodiment, the transmission is constructed so as to permit the impeller shaft to be positioned in offset relationship to the engine output shaft and in the other embodiment, the shafts are in line with each other.

14 Claims, 3 Drawing Sheets

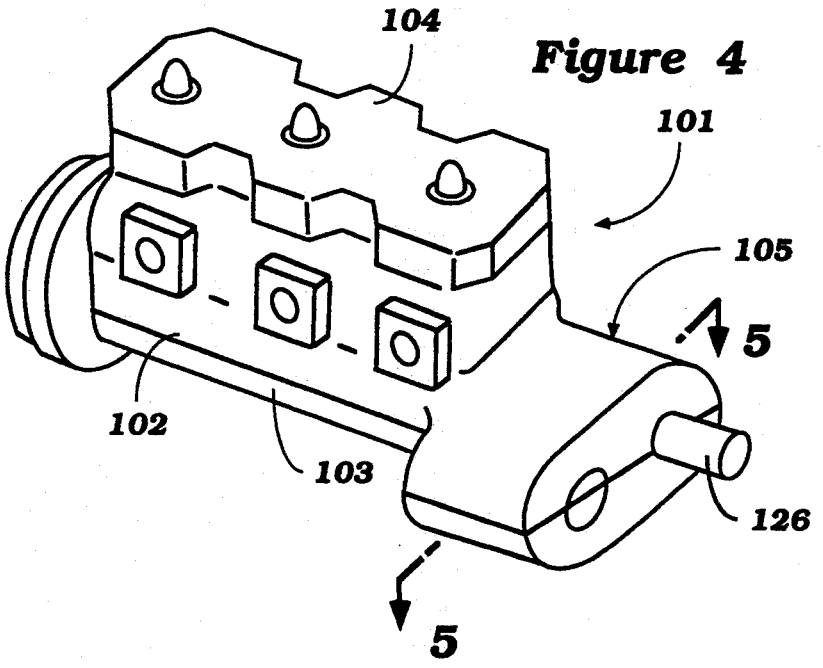
Figure 4
Figure 5
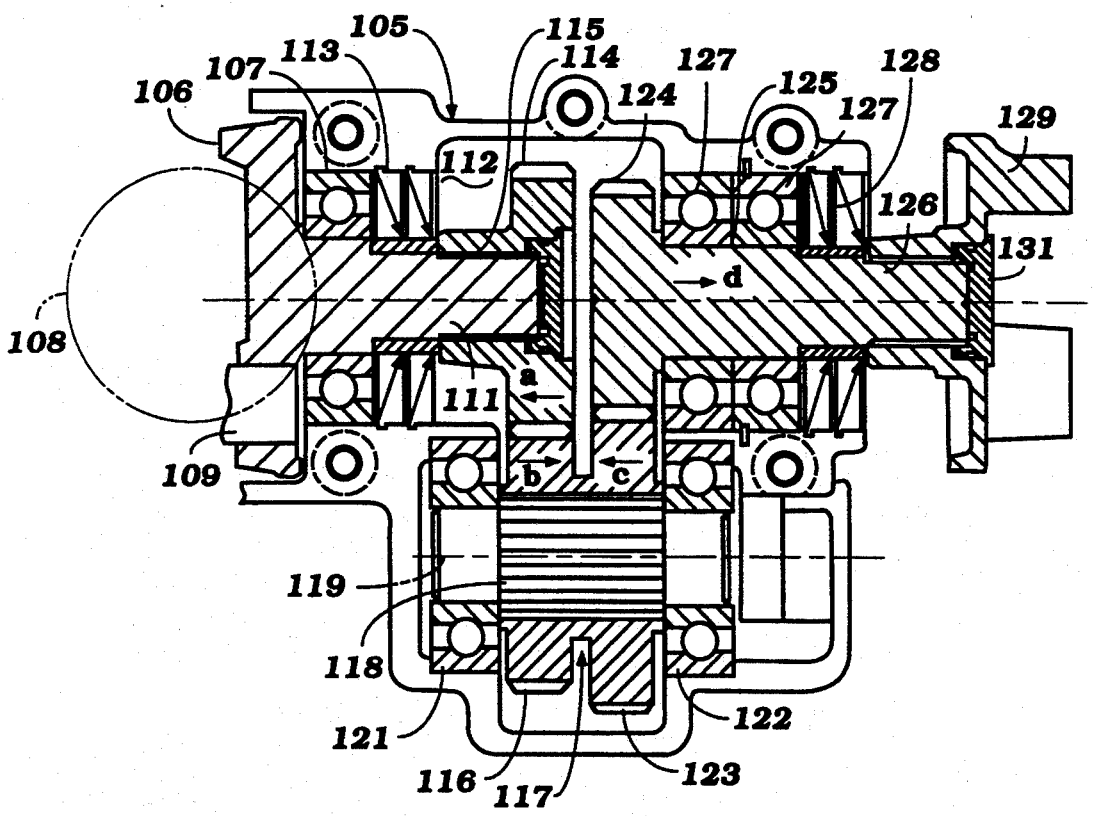

WATER INJECTION PROPULSION DEVICE

BACKGROUND OF THE INVENTION

This invention relates to a water injection propulsion device and more particularly to improved jet propulsion unit and drive therefore for a watercraft.

The use of water jet propulsion units for watercraft is well known and has a number of advantages over more conventional propeller type watercraft. However, in order to permit the use of a small compact propulsion unit, it is desirable to employ an engine that operates at a high speed range. As is well known, the higher of operational speed of the engine, the greater the power output for a given size. However, if the jet propulsion unit is driven at too high a velocity, its efficiency may decrease due to cavitation in the pumping system.

In order to avoid these problems, it has been proposed to utilize a speed reduction transmission of some form between the engine output shaft and the impeller shaft of the jet propulsion unit. This permits the engine to be driven at a high speed so as to achieve a high output for a low displacement but also insures that the impeller of the jet pump will not be driven at too high a speed so as to lose efficiency due to cavitation. However, the devices previously proposed for this purpose have required the interpositioning of a separate transmission between the engine output shaft and the impeller shaft. This adds to the number of couplings in the drive and further gives rise to problems in mounting in order to assure accurate alignment of the engine output shaft, the transmission shafts and the impeller shaft.

It is, therefore, a principal object to this invention to provide an improved water injection propulsion device for a watercraft.

It is a further object to this invention to provide a water injection propulsion system for a watercraft having a high speed engine with an integral speed reducing transmission formed as a part of one of the engine or the jet propulsion unit.

It is a further object to this invention to provide an improved water injection propulsion system wherein a speed reducing transmission is incorporated directly in the driving engine of the watercraft so as to avoid the necessity of separate couplings and minimize alignment difficulties.

SUMMARY OF THE INVENTION

This invention is adapted to be embodied in a jet propulsion unit for a watercraft having an internal combustion engine having an engine output shaft and a jet propulsion unit having an impeller shaft coupled to an impeller for pumping water. In accordance with the invention, a speed reducing transmission is formed integrally with one of the engine and jet propulsion units.

BRIEF DESCRIPTION OF THE DRAWINGS

FIG. 4 is a perspective view, in part similar to FIG. 2, and shows another embodiment of the invention.

FIG. 5 is a cross sectional view taken along a plane depicted by the line 5—5 of FIG. 4.

DETAILED DESCRIPTION OF THE PREFERRED EMBODIMENTS OF THE INVENTION

Figure 1:
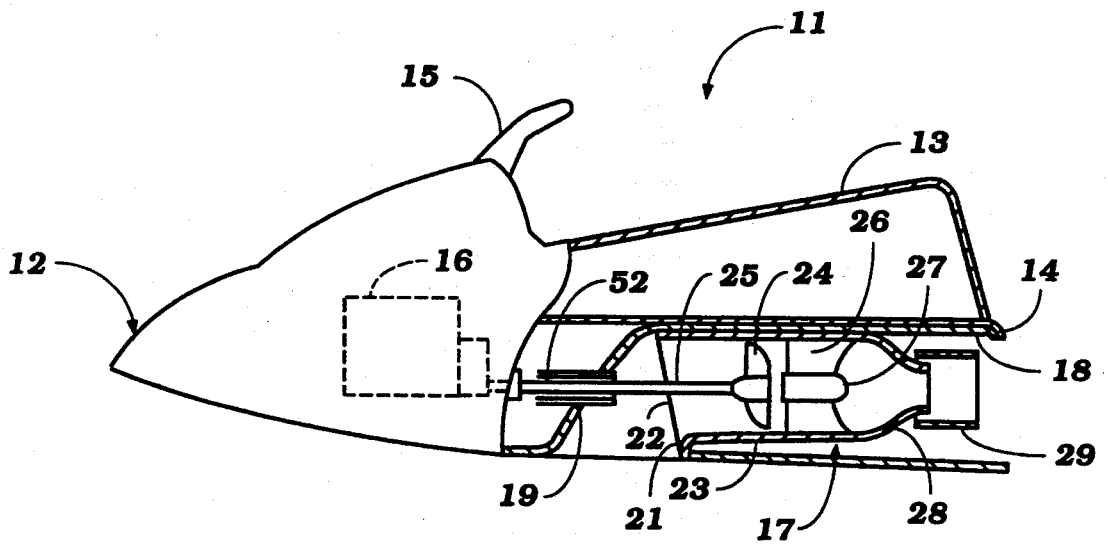
FIG. 1 is a side elevational view of a small watercraft constructed in accordance with a first embodiment of the invention, with a portion broken away.

Referring first in detail to FIG. 1, a small watercraft powered by a jet propulsion unit constructed in accordance with a first embodiment of the invention is identified generally by the reference numeral 11. Although the watercraft 11 shown in FIG. 1 is powered by a propulsion unit of the type shown in FIGS. 2 and 3, this watercraft is typical of those in which the invention may be employed and may also use a drive of the type shown in the embodiment of FIGS. 4 and 5. Also, it is to be understood that the construction of the watercraft 11 is described is being typical of those types of watercraft in which the invention may be utilized. It will be readily apparent to those skilled in the art how the invention can be utilized with a wide variety of types of watercraft. The invention, however, has particular utility in small watercraft due to the fact that it permits the use of a small displacement, high speed internal combustion engine, as will become apparent.

The watercraft 11 is comprised of a hull, indicated generally by the reference numeral 12 and which may have any desired configuration. The hull 12 is preferably formed from a material such as a molded fiberglass reinforced resin. In the illustrated embodiment, the watercraft 11 is of the type having a single motorcycle type seat 13 on which one or more riders may be seated in straddle, tandem fashion. The hull 12 is provided with a pair of foot areas on the side of the seat 13 in which the riders may place their feet. This foot area preferably opens through the rear or transom 14 of the watercraft 11 so as to facilitate entry and exit of the watercraft while in a body of water.

A handle bar assembly 15 is provided forwardly of the seat 13 and has certain controls for the propulsion unit of the watercraft 11, such as a throttle and steering control, as will be described.

Figure 2:
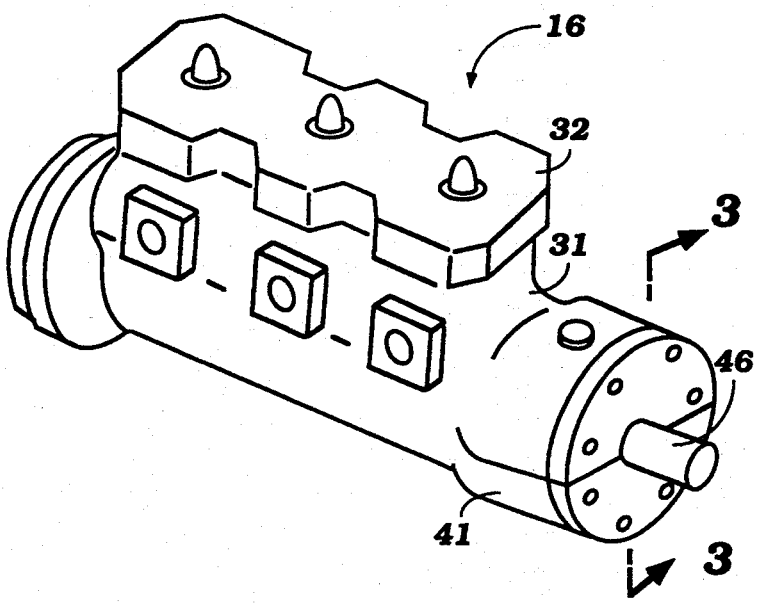
FIG. 2 is an enlarged perspective view of the powering internal combustion engine of this embodiment.
Figure 3:
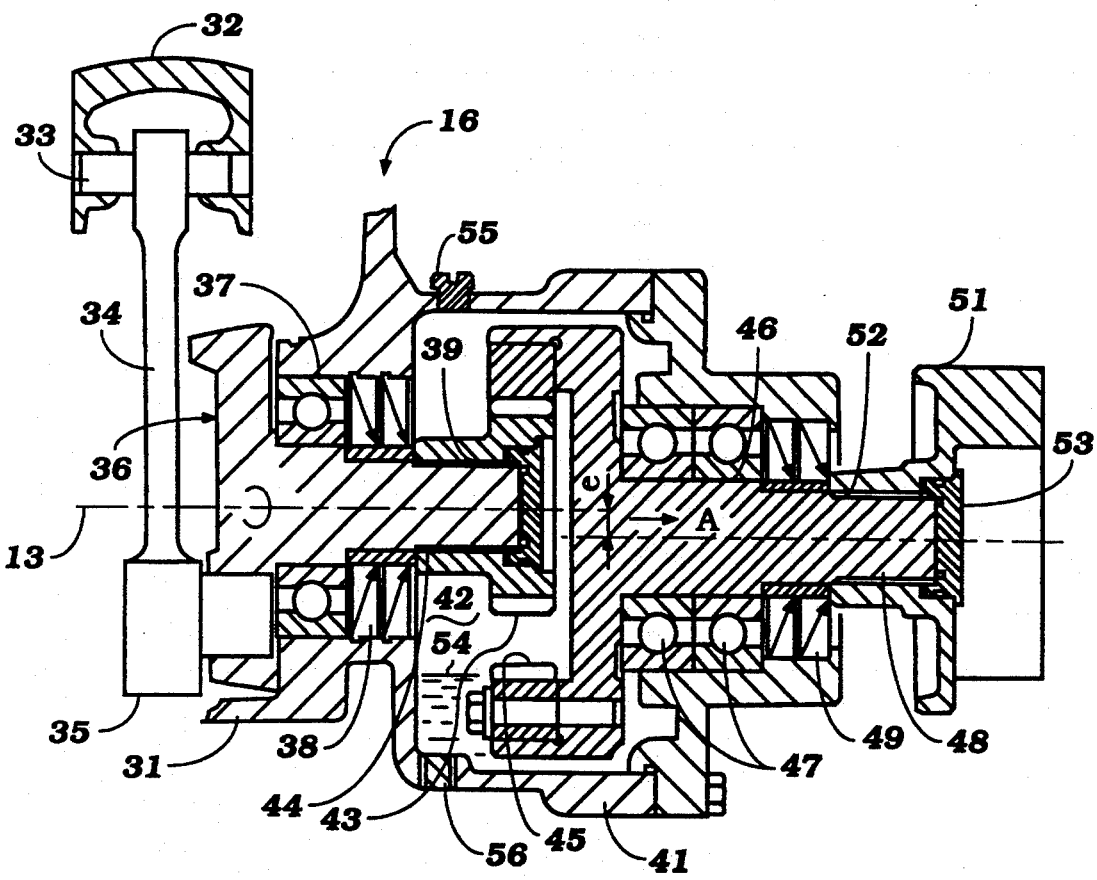
FIG. 3 is a cross sectional view taken along a plane indicating by the line 3—3 of FIG. 2.

The area forwardly of the seat 13 and beneath the handle bar assembly 15 in the hull 12 is provided with an engine compartment in which an engine, shown in phantom at 16 in FIG. 1 and in more detail in FIGS. 2 and 3, is positioned. This engine unit 16 drives, in a manner to be described, a jet propulsion unit, indicated generally by the reference numeral 17 which is provided in a tunnel 18 under the seat 13. The tunnel 18 is formed with an inclined forward portion 19 which has a downwardly facing opening 21 which forms a water inlet opening in combination with an opening 22 formed at the front end of an outer housing 23 of the jet propulsion unit 17.

An impeller 24 is affixed in a known manner to an impeller shaft 25 and is mounted for rotation in the housing 23 so as to draw water from the body of water in which the watercraft 11 is operating through the inlet thus far described. This water is then driven rearwardly pass a plurality of straightening vanes 26 formed on an nacel 27 which forms the rear pivotal support for the impeller shaft 25. The water is then discharged rearwardly through a discharge nozzle 28. A steering nozzle 29 is supported for steering movement about a vertically extending pivot axis by the discharge nozzle 28 and discharges the water back into the body of water in which the watercraft 11 is operating. The steering nozzle 29 is controlled by the handle assembly 15 in a well known manner.

The manner in which the engine 16 drives the impeller shaft 25 will now be described in more detail particularly by reference to FIGS. 2 and 3. As has been noted, the engine 16 may be of any known type and in the depicted embodiment, comprises a three cylinder, in-line engine operating on a two stroke, crankcase, compression principal. The engine 16 is not shown in any detail but generally comprises a crankcase cylinder block assembly 31 to which a cylinder head assembly 32 is affixed in any known manner. The cylinder block crankcase assembly 31 may be either comprised of a unitary assembly or two or more major components which are affixed to each other in any known manner.

As may be best seen in FIG. 3, the pistons, only one of which is shown and which is identified by the reference numeral 32, are connected by means of piston pins 33 to respective connecting rods 34 that are journalled on throws 35 of a crankshaft, indicated generally by the reference numeral 36. The crankshaft 36 is rotatably journalled within the crankcase cylinder block assembly 31 in any known manner and a rear main bearing 37 for this support appears in this figure. Suitably oil seals 38 are disposed at the output shaft end of the crankshaft 36 and this output end is indicated by the reference numeral 39.

The crankcase assembly 31 has a rearwardly extending integral transmission case portion 41 which also may be formed from a single piece or two or more major pieces connected to each other and which defines a transmission cavity 42. The crankshaft output end 39 extends into this transmission cavity 42 and has affixed to it a spur or pinion gear 43 as by means of a splined coupling 44. This pinion gear 43 is engaged with a ring gear 45 that is affixed to a transmission output shaft, indicated generally by the reference numeral 46.

This transmission output shaft 46 is journalled in the transmission case 41 by means of bearing assemblies 47 about a rotational axis "A" that is offset from the rotational axis "B" of the crankshaft 36 below it by an offset "e". The pinion gear ring gear combination 43, 45 is such so as to provide a speed reduction so that the speed of rotation of the transmission output shaft 46 will be substantially lower than the speed of rotation of the crankshaft 36. The desired speed ratio will be chosen by the desired maximum rate of speed of the engine 16 to achieve high power outputs and the corresponding speed of the impeller 24 at which cavitation will not occur.

The transmission output shaft 46 has an end portion 48? that extends through the rear of the transmission case 41 and around which oil seals 49 are positioned. A coupling member 51 is affixed to this output shaft portion 48, as by a splined connection 52 and fastener 53, and this coupling 51 affords a suitable connection to the impeller shaft 25 so as to drive the impeller shaft. Because of the offset of the axes of the crankshaft 36 and the transmission output shaft 46, the impeller shaft 25 can be positioned vertically below the engine output shaft which permits the engine to be raised slightly in the hull 12 and still accommodate the driving of the impeller shaft 25 at a reduced speed ratio.

The transmission casing 41 may be partially filled with a suitable lubricant, as shown by the line 54 in FIG. 3 and a fill plug 55 is provided for this purpose. A drain plug 56 is also incorporated so as to permit periodic servicing of the transmission fluid.

FIGS. 4 and 5 show another embodiment of this invention and this embodiment differs from the previously described embodiment only in the construction of the integral reduction transmission contained within the engine, indicated generally by the reference numeral 101 in this embodiment. Like the previously described embodiment, the engine 101 is provided with a cylinder block 102 and in this case, the cylinder block 102 has affixed to it a lower crankshaft forming member 103. A cylinder head assembly 104 is affixed to the cylinder block 102 in a known manner and the engine 101, as with the previously described embodiment, is being depicted as being of the three cylinder, in-line, crankcase, compression type.

An integral transmission casing 105 is formed by the rear portion of the cylinder block 102 and crankcase member 103 and in this embodiment the transmission is offset in a horizontal rather than a vertical direction, as with the previously described embodiment. As may be seen best in FIG. 5, the crankshaft 106 is rotatably journalled by means including a rear main bearing 107 and the stroke of the individual cylinders is indicated by the broken circle 108 with the rear throw 109 being depicted. The crankshaft 106 has an output shaft portion 111 that extends into a transmission cavity 112 formed by the transmission case 105. Oil seals 113 prevent leakage of the engine lubricant into the transmission cavity 112 and leakage from the transmission cavity 112 back into the engine crankcase chamber.

A first spur gear 114 is affixed by means of a splined connection 115 to the crankshaft output portion 111 and in turn meshes with a spur gear 116 of a compound gear 117 that is affixed by means of a splined connection 118 to a transmission secondary shaft 119 that is supported on a pair of spaced apart bearings 121 and 122 in the transmission case 105. The gear 116 is formed integrally with a second gear segment 123 which is enmeshed with a gear 124 that is affixed to or formed integrally with a transmission output shaft 125 that has an output end 126 that extends through the rear of the transmission case 105. The transmission output shaft 125 is journalled by means of a pair of spaced apart bearings 127 and oil seals 128 engage the outer end adjacent the output shaft portion 126. In this embodiment, the transmission output shaft 126 has its rotational axis aligned with the axis of rotation of the crankshaft 106.

The transmission comprised of the intermeshing gears 114, 116, 123 and 124 provides a step down in speed so that the transmission output shaft 126 is driven at a lower speed than the crankshaft 106 for the reasons already described. As is well known by those skilled in the art, a suitable transmission ratio can be selected so as to permit the engine 101 to achieve maximum power and a high speed while the impeller shaft can be driven at a suitable speed to avoid cavitation and provide good efficiency. A coupling 129 is affixed to the output shaft end 126 by means of a splined connection and fastener 131 and this coupling 129 is coupled to the impeller shaft previously described in a well known manner.

It should be readily apparent that the aforedescribed constructions permit the use of a high speed, high output, small displacement internal combustion engine that includes an integral step down transmission for driving an impeller shaft of a jet propulsion unit at speeds that will not achieve cavitation and will provide good propulsion efficiency. Of course, the foregoing description is that of preferred embodiments of the invention and various changes and modifications may be made without departing from the spirit and scope of the invention, as defined by the appended claims.

I claim:

1. A jet propulsion unit for propelling a watercraft comprised of an internal combustion engine having an outer housing member defining at least in part a combustion chamber and journalling an output shaft, a jet propulsion unit having an outer housing member defining at least in part a water inlet and journalling an impeller shaft to which an impeller is affixed for pumping water, one of said engine outer housing member and said jet propulsion unit outer housing member being formed as a unit with an integral non-detachable transmission case portion, and a speed reduction transmission contained within said integral transmission case portion for driving said impeller shaft at a reduced speed from said engine output shaft.

2. A jet propulsion unit for propelling a watercraft as set forth in claim 1 wherein the transmission includes a plurality of intermeshing gears.

3. A jet propulsion unit for propelling a watercraft as set forth in claim 2 wherein the intermeshing gears comprises a ring gear and a pinion gear so that the shafts associated with the rear gear and pinion gear can be axially offset from each other.

4. A jet propulsion unit for propelling a watercraft as set forth in claim 2 wherein the intermeshing gears are carried on a transmission input shaft, a transmission secondary shaft and a transmission output shaft with said transmission input shaft being drivingly coupled to the engine output shaft and said transmission output shaft being drivingly coupled to the impeller shaft.

5. A jet propulsion unit for propelling a watercraft as set forth in claim 2 wherein the transmission has offset input and output shafts.

6. A jet propulsion unit for propelling a watercraft as set forth in claim 5 wherein the input and output shafts are vertically offset from each other.

7. A jet propulsion unit for propelling a watercraft as set forth in claim 1 wherein the engine outer housing contains the transmission.

8. A jet propulsion unit for propelling a watercraft as set forth in claim 7 wherein the engine outer housing member is comprised of a cylinder block and the engine further comprises a crankcase affixed to said cylinder block and forming a further transmission case portion containing said speed reduction transmission.

9. A jet propulsion unit for propelling a watercraft as set forth in claim 8 wherein the transmission includes a plurality of intermeshing gears.

10. A jet propulsion unit for propelling a watercraft as set forth in claim 9 wherein the intermeshing gears comprises a ring gear and a pinion gear so that the shafts associated with the rear gear and pinion gear can be axially offset from each other.

11. A jet propulsion unit for propelling a watercraft as set forth in claim 9 wherein the intermeshing gears are carried on a transmission input shaft, a transmission secondary shaft and a transmission output shaft with said transmission input shaft being drivingly coupled to the engine output shaft and said transmission output shaft being drivingly coupled to the impeller shaft.

12. A jet propulsion unit for propelling a watercraft as set forth in claim 9 wherein the transmission has offset input and output shafts.

13. A jet propulsion unit for propelling a watercraft as set forth in claim 12 wherein the input and output shafts are vertically offset from each other.

14. A jet propulsion unit for propelling a watercraft as set forth in claim 8 wherein the cylinder block and crankcase have mating surfaces that are affixed to each other and wherein the transmission casing is formed between said mating surfaces.

* * * * *